US007903040B2

(12) United States Patent
Gevorgian et al.

(10) Patent No.: US 7,903,040 B2
(45) Date of Patent: Mar. 8, 2011

(54) TUNABLE ARRANGEMENTS

(75) Inventors: Spartak Gevorgian, Göteborg (SE); Anders Derneryd, Göteborg (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 420 days.

(21) Appl. No.: 10/597,811

(22) PCT Filed: Feb. 10, 2004

(86) PCT No.: PCT/SE2004/000164

§ 371 (c)(1),
(2), (4) Date: Apr. 13, 2007

(87) PCT Pub. No.: WO2005/076408

PCT Pub. Date: Aug. 18, 2005

(65) Prior Publication Data

US 2007/0257853 A1 Nov. 8, 2007

(51) Int. Cl.
*H01Q 3/44* (2006.01)

(52) U.S. Cl. ..... 343/787; 343/767; 343/909

(58) Field of Classification Search ..... 343/787, 343/767, 770, 771, 778, 846, 848, 754, 878, 343/909; 333/219, 235, 246
See application file for complete search history.

(56) References Cited

U.S. PATENT DOCUMENTS 6,175,337 B1 * 1/2001 Jasper et al. ..... 343/770
6,195,059 B1 2/2001 Falk
6,285,337 B1 * 9/2001 West et al. ..... 343/853
6,329,959 B1 12/2001 Varadan et al.
6,456,236 B1 * 9/2002 Hauck et al. ..... 342/372
6,525,695 B2 * 2/2003 McKinzie, III ..... 343/756
6,552,696 B1 * 4/2003 Sievenpiper et al. ..... 343/909
6,664,734 B1 * 12/2003 Jasper, Jr. ..... 315/3.5

(Continued)

FOREIGN PATENT DOCUMENTS

EP 517845 7/2002

(Continued)

OTHER PUBLICATIONS

Yang, Fan et al., "Applications of Electromagnetic Band-Gap (EBG) Structures in Microwave Antenna Designs", IEEE International Conference on Microwave and Millimeter Wave Technology Proceedings, pp. 528-531.

(Continued)

*Primary Examiner*—Douglas W Owens
*Assistant Examiner*—Chuc D Tran
(74) *Attorney, Agent, or Firm*—Potomac Patent Group PLLC

(57) ABSTRACT

The present invention relates to a tunable microwave/millimeter-wave arrangement comprising a tunable impedance surface. It comprises an Electromagnetic Bandgap Structure (EBG) (Photonic Bandgap Structure) comprising at least one tunable ferroelectric layer (3), at least one first, top, metal layer (1) and at least one second metal layer (2A, 2B). Said first (1) and second metal layers (2A) are disposed on opposite sides of the/a ferroelectric layer (3), and at least the first, top, metal layer (1) is patterned and the dielectric permittivity of the at least one ferroelectric layer (3) is dependent on a DC biasing voltage directly or indirectly applied to first (1) and/or second (2A, 2B) metal layers disposed on different sides of the/a ferroelectric layer.

28 Claims, 8 Drawing Sheets

U.S. PATENT DOCUMENTS

| | | | | |
|---|---|---|---|---|
| 6,756,947 | B2 * | 6/2004 | Toncich et al. | 343/767 |
| 6,806,846 | B1 * | 10/2004 | West | 343/909 |
| 6,952,307 | B2 * | 10/2005 | Apostolopoulos et al. | 359/321 |
| 6,972,727 | B1 * | 12/2005 | West et al. | 343/771 |

FOREIGN PATENT DOCUMENTS

| | | | |
|---|---|---|---|
| JP | 2003-185990 | A | 7/2003 |
| WO | 0247206 | A1 | 6/2002 |
| WO | 2005/064737 | A1 | 7/2005 |

OTHER PUBLICATIONS

Mailloux, R.J., "Phase array antenna handbook", Artech House, Boston, 1994.

Redvik, Jonathan et al., "PGB Evaluation for Base Station Antennas", 24th ESTEC Antenna Workshop in Innovative Periodic Antennas: Photonic Bandgap, Fractal and Frequency Selective Structures (WPP-185), pp. 5-10, 2001.

Sivenpiper, D. et al., "Beam Steering microwave reflector based on electrically tunable impedance surface", Electronics Letters, vol. 38, No. 21, Oct. 10, 2002, pp. 1237-1238.

Yang, Fan et al., "Reflection Phase characterizations of the EBG Ground Plane for Low Profile Wire Antenna Application", IEEE Transactions on Antennas and Propagation, vol. 51, No. 10, Oct. 2003, pp. 2691-2703.

Kuylenstierna, D. et al., "Tunable Electromagnetic Bandgap Performance of Coplanar Waveguides periodically loaded by Ferroelectric Varactors", Microwave and Optical Technology Letters, vol. 39, No. 2, Oct. 20, 2003, pp. 81-86.

PCT International Search Report, mailed Sep. 28, 2004, in connection with International Application No. PCT/SE2004/000164.

* cited by examiner

TUNABLE ARRANGEMENTS

This application is a U.S. national stage application of International Application No. PCT/SE2004/000164.

FIELD OF THE INVENTION

The present invention relates to a tunable microwave/millimeter-wave arrangement comprising a tunable impedance surface. Particularly the invention relates to such an arrangement comprising a beam scanning antenna or a frequency selective surface or a phase modulator. Even more particularly the invention relates to such an arrangement comprising a reflection and/or a transmission type antenna.

STATE OF THE ART

It has been realised that in some microwave systems of different kinds, for example microwave telecommunication systems, tunable arrangements which comprise a tunable impedance surface are required. Particularly it has been realised that arrangements having a small size and being adaptable or reconfigurable are needed. It has also been realised that for example beam scanning antennas or phase modulators are needed which are small sized, adaptable or reconfigurable and cost effective. Phased array antennas are known which utilize phase shifters, attenuators and power splitters based on semiconductor technology. However, they are expensive, large sized devices which also require a high power consumption. Such phased array antennas are for example described in "Phased array antenna handbook", by R. J. Mailloux, Artech House, Boston 1994. Also such antennas based on semiconductor technology are known, but they are quite expensive, large and require a high power consumption.

Recently ferroelectrics has been considered in order to be able to reduce the size of for example tunable antennas and also to reduce the power consumption. Tunable antennas based on ferroelectrics are for example described in U.S. Pat. No. 6,195,059 and (SE-C-513 223), in U.S. Pat. No. 6,329,959 and in SE-C-517 845.

The antenna suggested in SE-C-513 223 has a simple design and it is expected to be quite cost effective. In this design it is possible to achieve the desired phase amplitude distribution across the surface of the antenna. However, it is a drawback of this antenna that it needs extremely large DC voltages in order to be able to allows for beam scanning. U.S. Pat. No. 6,329,959 suggests an antenna utilizing the DC field dependent permittivity of ferroelectric materials. However, it does not address any tunable surface impedance or beam scanning capabilities.

SE-C-517 845 describes a ferroelectric antenna which however does not allow for a beam scanning functionality.

Still further, in "Beam steering microwave reflector based on electrically tunable impedance surfaces" by D. Sievenpiper, J. Schaffner, in Electronics Letters, Vol. 38, no. 21, pp. 1237-1238, 2002, an antenna is disclosed which has a simple design and which uses lumped semiconductor varactors to control the beam. However, the use of semiconductor varactors makes the design very expensive, particularly when large antenna arrays are concerned. Thus, none of these suggested arrangements functions satisfactorily and they are all generally complicated from a design point of view and require high DC voltages for tuning.

SUMMARY OF THE INVENTION

What is needed is therefore a tunable microwave arrangement comprising a tunable impedance surface which is small, cost-effective and which does not require a high power consumption. Still further an arrangement is needed which is adaptable or reconfigurable. Particularly an arrangement is needed which can be used as a beam scanning antenna or as a phase modulator, for example in microwave telecommunication systems. Still further an arrangement is needed which has a simple design. A beam scanning antenna fulfilling one or more of the above mentioned objects is also needed. Still further a phase modulating arrangement meeting one or more of the above mentioned requirements is needed. Particularly an arrangement is needed through which it is possible to control microwave signals in free space or in a cavity waveguide particularly for changing the phase and/or the amplitude distribution of the microwave signals, reflected and/or transmitted through it. An arrangement is also needed which is easy to fabricate.

Therefore an arrangement as initially referred to is provided which comprises an electromagnetic bandgap structure (EBG), also denoted a photonic bandgap structure with at least one tunable ferroelectric layer. At least a first or top metal layer and least one second metal layer are so arranged that the first and second metal layers are disposed on opposite sides of the ferroelectric tunable layer. At least the first, top, metal layer is patterned and the dielectric permittivity of the at least one ferroelectric layer depends on an applied DC field.

The use of photonic bandgap (PBG), i.e. EBG, materials for base station antennas is described in PBG Evaluation for Base Station Antennas by Jonathan Redvik and Anders Derneryd in $24^{th}$ ESTEC Antenna Workshop on Innovative Periodic Antennas: Photonic Bandgap, Fractal and Frequency Selective Structures (WPP-185), pp. 5-10, 2001.

Recently there has been much investigation concerning the use of planar photonic bandgap (PBG) structures, also called electromagnetic crystals, for microwave and millimeter-wave applications. Ferroelectromagnetic crystals are particularly attractive since they are easy to fabricate at a low cost and compatible with standard planar circuit technology. Photonic bandgap structures are artificially produced structures which are periodic either in one, two or three dimensions. Since they have similarities with the periodic structure of natural crystals, they are also denoted electromagnetic crystals. These artificially produced materials are denoted photonic bandgap materials or photonic crystals. Bandgap here applies to electromagnetic waves of all wavelengths. Actually the existence of an electromagnetic bandgap where propagation of an electromagnetic wave is prohibited, is in analogy to the electronic bandgap forming the basis of semiconductor technology and applications. Thus the photonic bandgap materials form a new class of periodic dielectrics being the photonic analogy of semiconductors. Electromagnetic waves behave in photonic crystals in a manner similar to that of electrons in semiconductors.

According to the invention at least the first patterned metal layer is so patterned as to form or comprise an array of radiators, which most particularly comprise resonators. The resonators may for example comprise patch resonators which may be circular, square shaped, rectangular or of any other appropriate shape. Particularly the radiators, e.g. the resonators, are arranged such as to form a two-dimensional (2D)

array, e.g. a 2D array antenna. Particularly it comprises a reflective antenna. Particularly the radiators of the first, top, metal plane are galvanically connected, by means of via connections through the ferroelectric layer, with the/a further, second metal layer. The (if any) intermediate second metal layer is patterned, or provided with holes, enabling passage of the via connections therethrough. The via connections are used for connecting the radiators of the first top layer with an additional (bottom) second metal layer which may be patterned or not, and a DC biasing (control) voltage is applied between the two second metal layers to change the impedance of the (top) radiator array and thus the resonant frequency of the resonators, e.g. the radiators through changing the permittivity of the ferroelectric layer. Advantageously the via connections are connected to the center points of two radiators where the radio frequent (RF) (microwave) current is the highest. Particularly the radiator or resonator spacing in the top layer is approximately 0.1 cm, approximately corresponding to $\lambda_0/30$, wherein $\lambda_0$ is the free space wavelength of the microwave signal. Through controlling the DC biasing voltage, the impedance of the array of radiators can be changed from inductive to capacitive, reaching infinity at the resonant frequency of the radiators or resonators. Particularly the top array of radiators comprises around 20×20 radiators and the dielectric permittivity ($\in(V)$) of the ferroelectric layer is approximately 225-200 or e.g. between 50 and 20000, the ferroelectric layer having a thickness about 50 μm. It should be clear that these values only are given for exemplifying reasons and of course any other appropriate number of radiators can be used, and as referred to above, they may be circular in shape or of any other appropriate form. Also the dielectric permittivity of the ferroelectric layer may be another but it has to be high. The dielectric permittivity may even be as high as up to several times ten thousand, or even more. Still further the thickness of the ferroelectric layer may in principle deviate considerably from the exemplifying value of 50 μm.

According to an alternative implementation of a reflection type radiator array, there are but a first metal layer and a second metal layer, of which the first (top) layer comprises radiators (e.g. patch resonators) and the second may be patterned, but preferably it is unpatterned. Then the DC biasing voltage is applied to these two metal layers, thus no via connection between layers are needed.

In an alternative implementation the arrangement comprises a transmission type arrangement, e.g. a transmission antenna. The radiators may be arranged in 2D arrays, comprising said first and second metal layers, between which the ferroelectric layer is disposed. Particularly the second metal layer also is patterned comprising radiators arranged with the same periodicity as the radiators of the first, top, metal layer, but displaced by an amount corresponding substantially to the spacing between the radiators in a layer or in a plane.

Dielectric or ferroelectric layers may be provided on those sides of the first and second metal layers, i.e. the radiator (resonator) arrays, which are not in contact with said ferroelectric layer. Particularly a DC voltage is applied to the arrays and the same DC voltage is provided to each individual radiator for changing the dielectric permittivity of the ferroelectric layer and hence the resonant frequency of the radiators. Particularly the arrangement comprises a wavefront phase modulator for changing the phase of a transmitted microwave signal.

In an alternative embodiment the radiators of the arrays are individually biased by a DC voltage. In a particular implementation it may comprise a beam scanning antenna. Then separate impedance DC voltage dividers may be connected to the radiators, one for example in the X-direction and one in the Y-direction (one to one of the radiator arrays, one to the other), to allow for a non-uniform voltage distribution in the X-, and Y-direction respectively, allowing a tunable, non-uniform modulation of the microwave signal phase front.

The impedances particularly comprises resistors. In an alternative implementation the impedances comprise capacitors. Still further some of the impedances may comprise resistors whereas others comprise capacitors. Each radiator may, separately and individually be connected to the DC biasing voltage over a separate resistor or capacitor.

The thickness of the ferroelectric layer may be between 1 μm up to several mm:s, the DC biasing voltage may range from 0 up to several kV:s.

In one implementation, of a transmission arrangement, the first and second metal layers may comprise each a number of radiators, wherein the radiators of the first and second layers have different configuration and/or are differently arranged. Particularly different coupling means are provided for the radiators of said first and second layers respectively. A DC biasing or a control voltage may be supplied to the radiators of said first and second metal layers in order to change the lumped capacitance and thus the capacitive (weak) coupling between the radiators, which for example may be patch resonators as referred to above.

Still further the tunable radiator array or arrays may be integrated with a waveguide horn, such that the horn will scan a microwave beam in space or modulate the phase of a microwave signal.

Particularly the arrangement comprises a 3D tunable radiator array, for example used as a filter, or a multiplexor/demultiplexor etc. Particularly the spacing between radiators or resonators in a layer corresponds to a factor 0.5-1.5 times the wavelength of an incident microwave signal in the ferroelectric layer.

The invention suggests a use of an arrangement according to the above description in any implementation for controlling microwave/(sub)millimeterwave signals in free space or cavity waveguides, or for changing the phase and/or the amplitude distribution of the signals reflected and/or transmitted through it.

For reflective antennas both metal layers may be patterned but not necessarily, on the contrary, the bottom metal layer is preferably non-patterned. Particularly the layer furthest away from the incident microwave signal is not patterned. In a transmission antenna generally all metal layers are patterned. Both for transmission and reflection type arrangements multilayer structures can be used, with metal layers and ferroelectric layers arranged according to the inventive concept in an alternating manner.

It should be clear that the inventive concept covers many applications and that it can be varied in a number of ways. The invention suggests a tunable impedance surface based on a ferroelectric layer and an electromagnetic bandgap structure instead of based on semiconductors.

BRIEF DESCRIPTION OF THE DRAWINGS

The invention will in the following be more thoroughly described, in a non-limiting manner, and with reference to accompanying drawings, in which.

DETAILED DESCRIPTION OF THE INVENTION

Figure 1A:
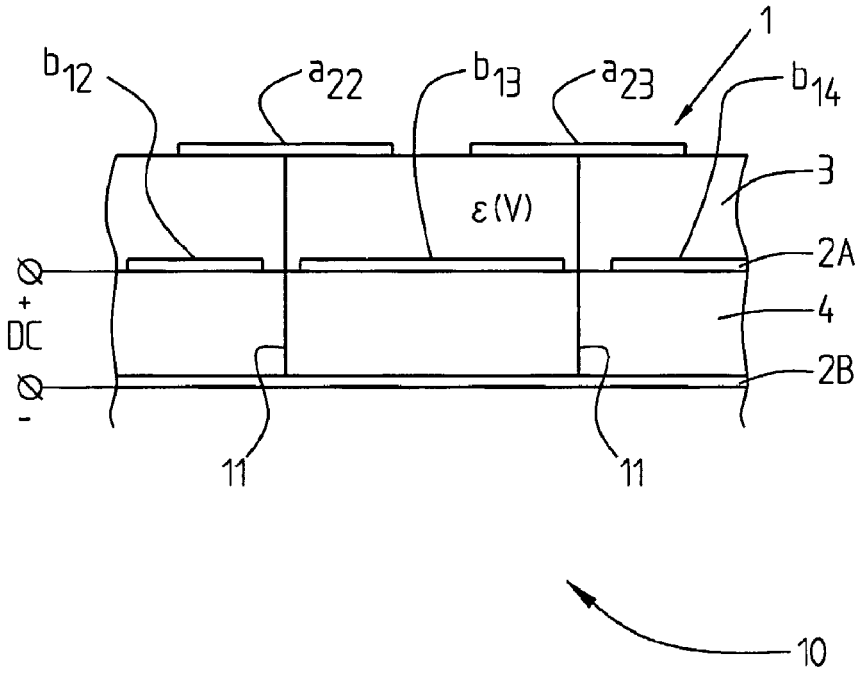
FIG. 1A shows a first embodiment of a reflective radiator array in cross-section.

FIG. 1A shows a first embodiment of the invention comprising an arrangement in the form of a reflective radiator array 10. It comprises a first metal layer 1 comprising a number of radiators $a_{22}$, $a_{23}$, of which only these two radiators are illustrated since FIG. 1A only shows a fragment of the radiator array and it is shown in its entirety in FIG. 2.

Between the first metal layer 1 comprising the reflective radiators $a_{22}$, $a_{23}$ and a second metal layer 2A which is patterned to form a split-up structure with openings, comprising, here, elements $b_{12}$, $b_{13}$, $b_{14}$ which are so disposed that tiny openings are provided, a ferroelectric layer 3 is disposed. The ferroelectric layer comprises a high dielectric permittivity which is DC field dependent ($\in$(V)). The ferroelectric material may comprise a thin or a thick film layer, a ceramic etc. $\in$(V) may be between 225 and 200, although these values only are given for exemplifying reasons. As referred to above it may be lower as well as considerably higher up to 20000, 30000 or more. The dielectric permittivity may of course be of this magnitudes for every embodiment disclosed herein and covered by the inventive concept. A further second metal layer 2B is disposed below the second metal layer 2A, between which metal layers 2A, 2B a conventional dielectric layer 4 is disposed. The holes or openings in the "first", upper second metal layer 2A are so arranged that via connections between the first metal layer 1 with radiators and the "bottom" metal layer 2B can pass therethrough for galvanically connecting the centerpoints of the radiator patches $a_{22}$, $a_{23}$ (corresponding to maximum microwave or RF current) with the second metal layer 2B. The second metal layer 2A here forms a RF ground plane whereas the second metal layer 2B form a DC bias plane, and a DC biasing voltage applied between the second metal layers 2A, 2B will change the dielectric permittivity of the ferroelectric layer 3, and hence also change the resonant frequency f(V) of the patch resonators $a_{22}$, $a_{23}$, which depends on $\in$(V) as follows from the following relationship:

$$f(V) = \frac{c_n}{2a\sqrt{\varepsilon_f(V)}},$$

a being the length of the side of the square patch resonator. According to the invention the ferroelectric material having a high dielectric permittivity which is strongly dependent on the applied DC field, makes it possible to control the impedance of the radiators and the phase distribution of incident waves reflected from the array. Since the dielectric permittivity is high, the size of the arrangement, particularly the antenna, can be made very small (the microwave wavelength in the ferroelectric material is inversely proportional to the square root of the permittivity, as referred to above), which enables fabrication of monolithically integrated radiator arrays, for example using group fabrication technology such as LTCC (Low Temperature Cofired Ceramic), thin epitaxial film technology or similar. These materials are extremely good dielectrics with virtually no leakage (control) currents.

According to the invention the radiators, particularly resonators, here form a 2D array antenna implemented in the form of an electromagnetic bandgap (photonic bandgap) structure as discussed earlier in the application. The tunable reflective array as illustrated in FIG. 1A is potentially useful for frequencies between 1 and 50 GHz.

The patch radiators may in principle have any shape, square shaped (as in this embodiment), rectangular or circular etc. The second metal planes, in the embodiment of FIG. 1A, 2 also denoted RF and DC metal planes, or plates, form an effective ground plane for the patch resonators.

Figure 1B:
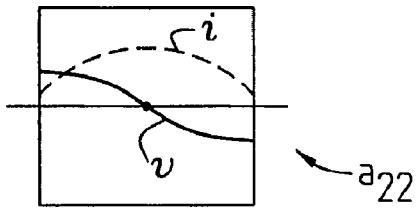
FIG. 1B is a plane view illustrating the microwave current and voltage distributions of a radiator element of the embodiment of FIG. 1A.

FIG. 1B shows the current and voltage microwave distribution in radiator patch $a_{22}$ as an example. At the central point of the patch it is galvanically connected with the DC biasing plane 2B. The center point corresponds to current maximum as can be seen from the figure.

Figure 2:
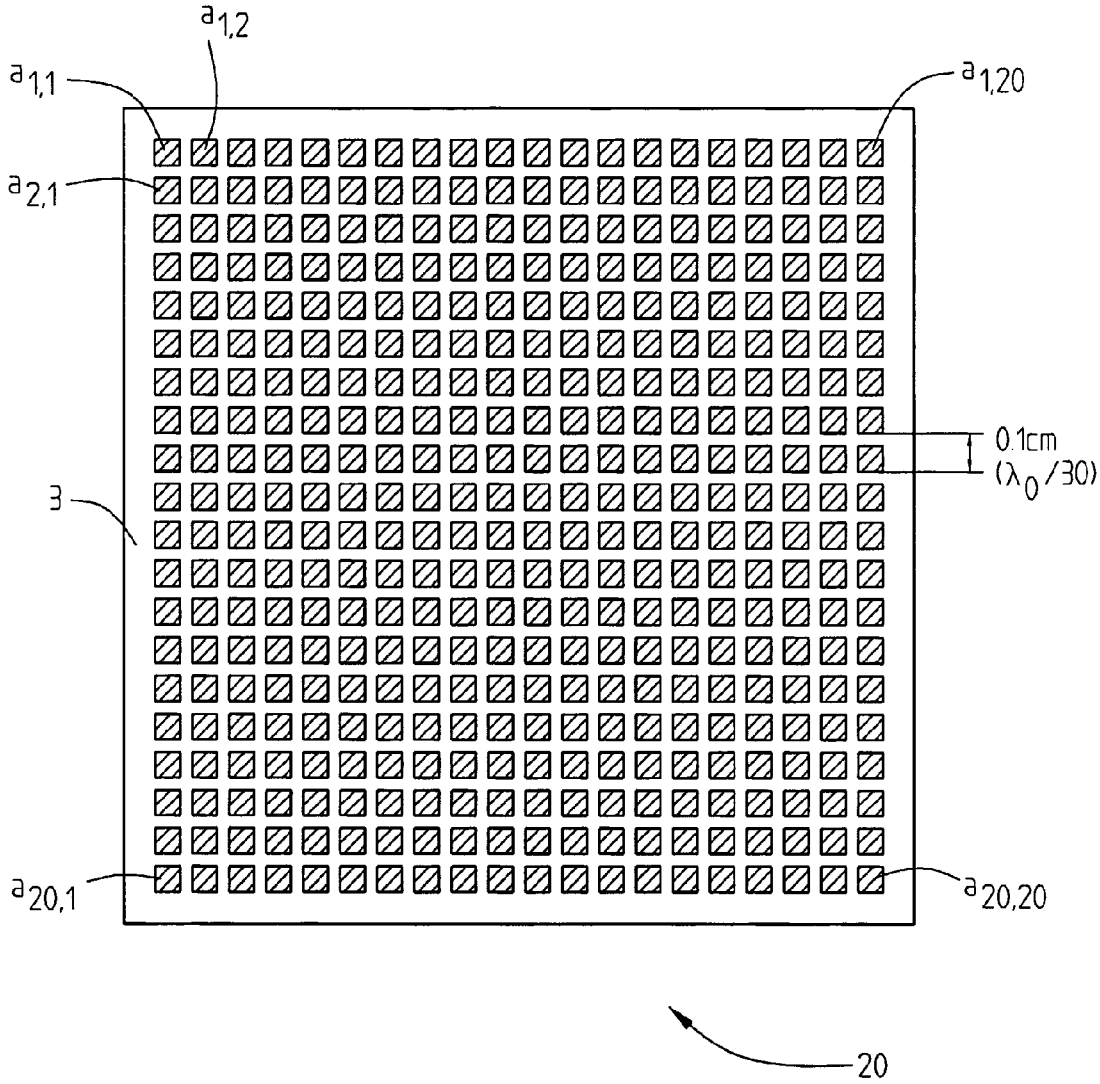
FIG. 2 is a plane view of the entire reflective radiator array according to the embodiment of FIG. 1A.

FIG. 2 shows, in a simplified manner, the entire reflective array of which the fragment described in FIG. 1A forms a small portion. It here comprises 400 radiators disposed in 20 columns and 20 rows. It is supposed that the side a of each patch radiator comprises 0.8 mm. The radiator pitch, i.e. the distance between corresponding edges or center points of two radiators is here 0.1 cm, approximately corresponding to $1/30\times\lambda_0$, $\lambda_0$ being the wavelength of the microwaves in free space, and the size of the array will be 2.0 cm×2.0 cm, $\lambda_0$=3 cm. By changing the DC biasing voltage, the impedance of the array will change from inductive impedance to capacitive impedance, reaching infinity at resonant frequency. In this embodiment it is supposed that the thickness of the ferroelectric layer 3 comprises 50 μm. It should be clear that the shape of the patch radiators, the number of the patch radiators, the thicknesses of the layers, the grid layout etc. merely are given for exemplifying reasons.

An array as disclosed in FIG. 2 may be fabricated using a standard cost-effective ceramic technology such as LTCC based on solid solutions of ferroelectric materials such as $Ba_xSr_{1-x}TiO_3$ or a material with similar properties.

It should be clear that the inventive concept is likewise applicable to other grid layouts than squareshaped or rectangular layouts. The grid may e.g. also be triangular or of any other appropriate shape.

Figure 3:
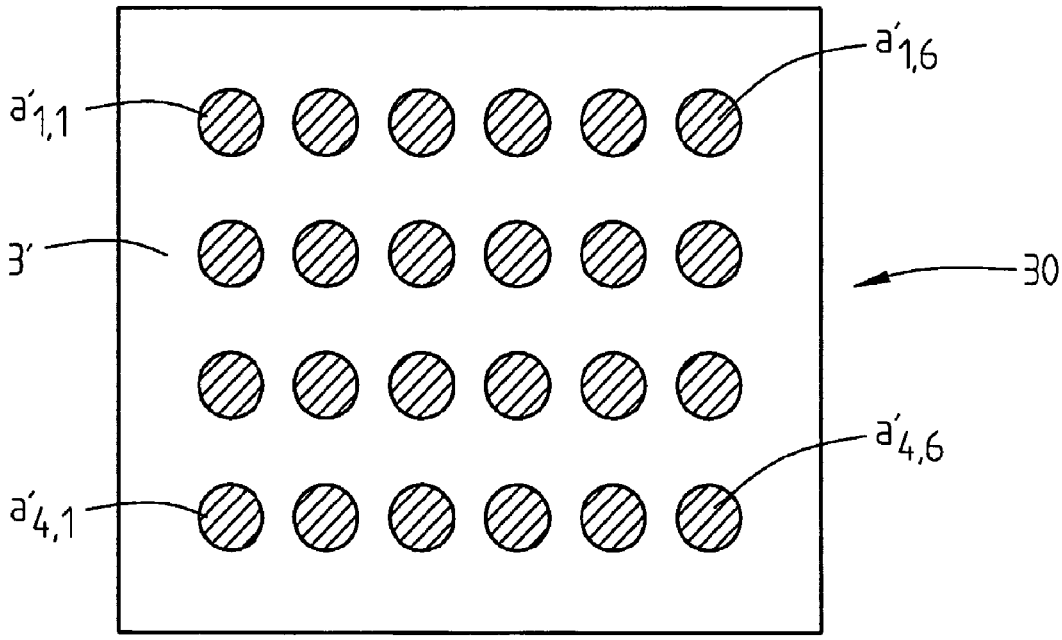
FIG. 3 shows, in a simplified manner, a plane view of a reflective radiator array according to another embodiment.

FIG. 3 is a plane view of another reflective array 30 here comprising a number of circular radiator patches $a'_{1,1}$, . . . , $a'_{1,6}$, . . . , $a'_{4,1}$, . . . , $a'_{4,6}$. They are disposed on a ferroelectric layer 3', e.g. as in FIG. 1A. In other aspects the functioning may be similar to that of FIG. 1A with two second metal layers between which a DC bias is applied etc. although this is not necessarily the case; a DC biasing may also be applied between the first metal layer comprising the circular radiator patches and the (only, e.g. non-patterned) second metal layer (not shown).

Figure 4:
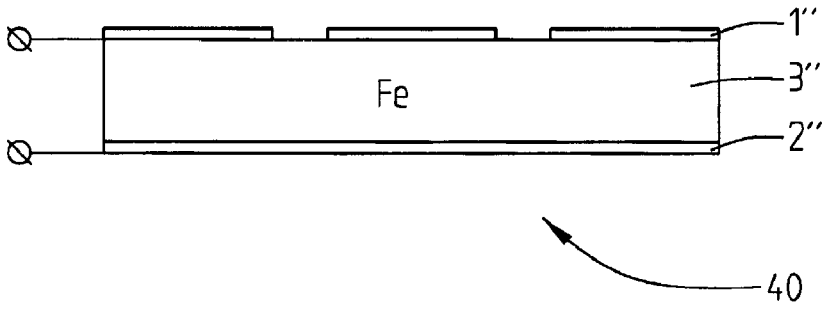
FIG. 4 shows, in a simplified manner, another embodiment of a reflective radiator array (in part), in cross-section.

FIG. 4 shows another implementation of an arrangement 40 with a number (only three illustrated) reflective radiator patches 1" arranged on a ferroelectric layer 3", which in turn is disposed on a second metal layer 2". As can be seen in this case there is only one second metal layer 2, which in this case is not patterned. In this case the DC biasing voltage has to be applied to the radiator patches themselves and to the second metal layer 2". The arrangement disclosed in FIG. 3 may thus in cross-section look like the arrangement of FIG. 4, or like the fragment 10 of an arrangement 20 of FIG. 1A, 2.

Figure 5:
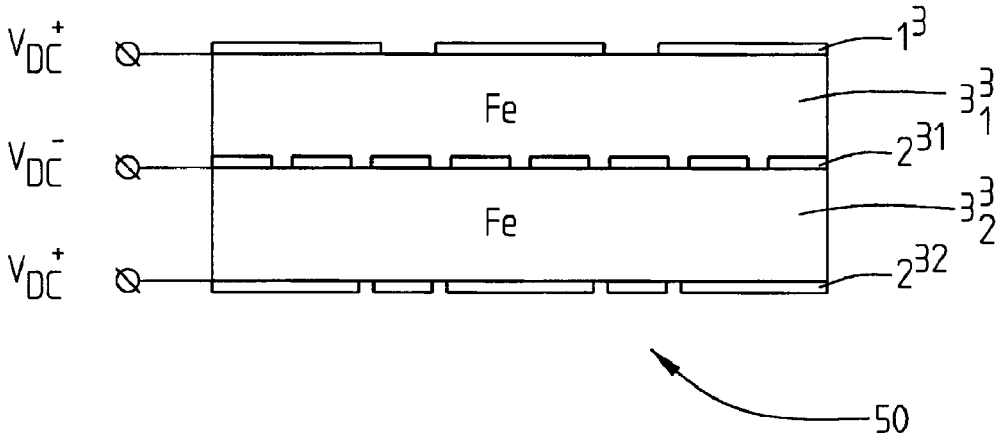
FIG. 5 shows a further embodiment of a reflective array comprising a multilayer structure.

FIG. 5 shows still another arrangement 50 with a reflective radiator array comprising a first metal layer $\mathbf{1}^3$ with a number of radiator patches and a second metal layer $\mathbf{2}^{31}$, between which a first ferroelectric layer $\mathbf{3}_1{}^3$ is disposed, and wherein below said second metal layer $\mathbf{2}^{31}$ a second ferroelectric layer $\mathbf{3}_2{}^3$ is disposed, below which there is another second metal layer $\mathbf{2}^{32}$. Both of the second metal layers $\mathbf{2}^{31}$, $\mathbf{2}^{32}$ are patterned, however they are patterned in different manners. A DC biasing voltage is applied to each metal layer, including the first metal layer $\mathbf{1}^3$ comprising the radiator patches. This embodiment is illustrated merely in order to show that also the bottom layer in a reflective array might be patterned, although presumably it is more advantageous if it comprises a solid layer, i.e. an unpatterned layer, most preferably similar to the embodiment as illustrated in FIG. 1A (although e.g. being a multilayer structure).

In the following some examples on implementation of the inventive concept for transmission type arrangements, will be disclosed.

Figure 6A:
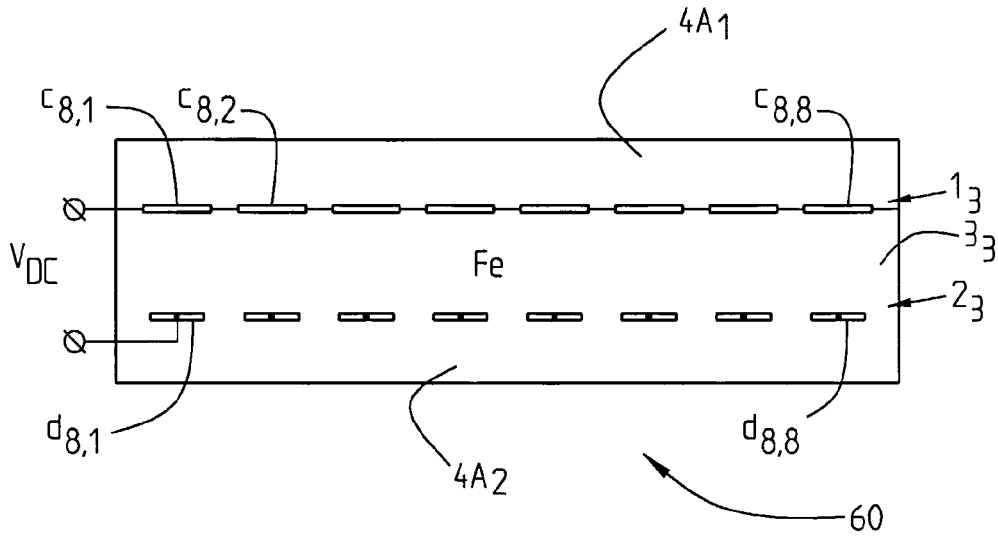
FIG. 6A is a cross-sectional view of a transmissive radiator array comprising an EBG wavefront phase modulator.

FIG. 6A is a cross-sectional view of a first arrangement 60 of a transmission type array comprising a first array of patch antennas $c_{1,1}, c_{1,2}, \ldots, c_{8,8}$ provided in a 2D array (in FIG. 6A only patches $c_{8,1}, \ldots, c_{8,8}$ are shown) and forming a first metal layer 13. A second array of patch antennas $d_{8,1}, \ldots, d_{8,8}$ form a second metal layer 23. Between these two arrays $\mathbf{1}_3$, $\mathbf{2}_3$ of patch antennas, a tunable ferroelectric film layer $\mathbf{3}_3$ is sandwiched. The thickness of the ferroelectric film may typically be less than 50 μm, although the inventive concept of course not is limited thereto. On those sides of the first and second metal layers $\mathbf{1}_3$, $\mathbf{2}_3$ facing away from the intermediate ferroelectric layer $\mathbf{3}_3$, conventional dielectric layers $\mathbf{4}A_1$, $\mathbf{4}A_2$ are provided. The first and second metal layers are DC biased as schematically illustrated in FIG. 6A.

Figure 6B:
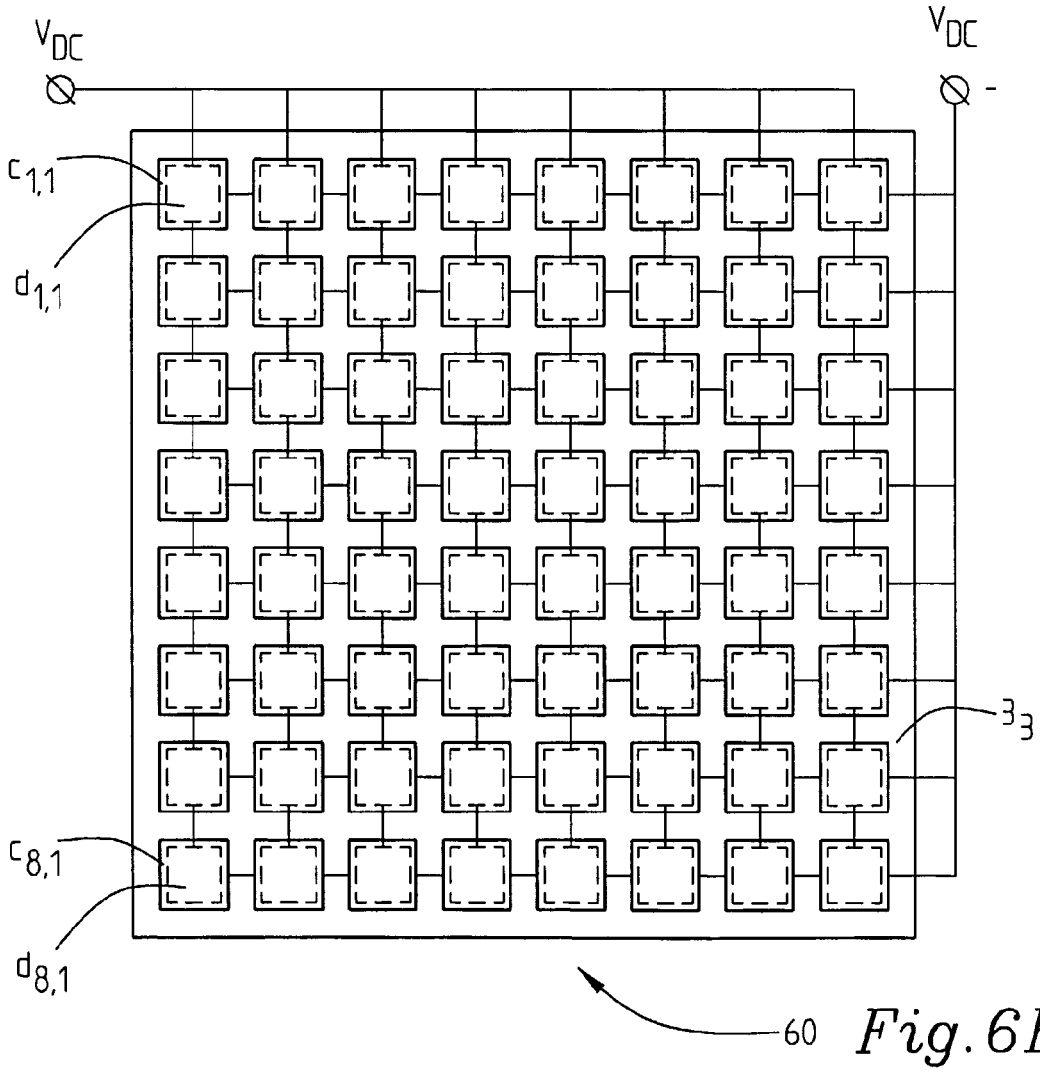
FIG. 6B is a plane view of the arrangement according to FIG. 6A.

FIG. 6B is a plane view of the arrangement shown in FIG. 6A seen from above with dielectric layer 4A, removed. In this embodiment the radiator patches of the top layer are illustrated, here comprising radiator patches $c_{1,1}, \ldots, c_{8,8}$. In this embodiment the radiator patches of the first metal layer $\mathbf{1}_3$ are somewhat larger than the radiator patches of the second metal layer $\mathbf{2}_3$, which are not shown in the figure. A DC voltage is applied to all the radiator patches of the second metal layer $\mathbf{2}_3$ shown by a faint horizontal line. The radiator patches of the second metal layer $\mathbf{2}_3$ (not shown) are interconnected column-wise such that all radiator patches of said second layer are supplied with the same DC voltage. Also the radiator patches of the first metal layer $\mathbf{1}_3$ are connected to a DC bias voltage (all to the same as opposed to the patches in FIGS. 7A, 7B) and these radiator patches are, as can be seen from the figure, interconnected row-wise. The arrangement 60 of FIG. 6A, 6B comprises a frequency tuneable EBG wave front phase modulator. The DC voltage supplied to the arrays, will change the dielectric permittivity of the intermediate ferroelectric layer $\mathbf{3}_3$, and hence the resonant frequency of the radiators. As referred to above, the arrangement of FIG. 6A, 6B provides for a uniform modulation of a phase front and no scanning of the beam is enabled.

Figure 7A:
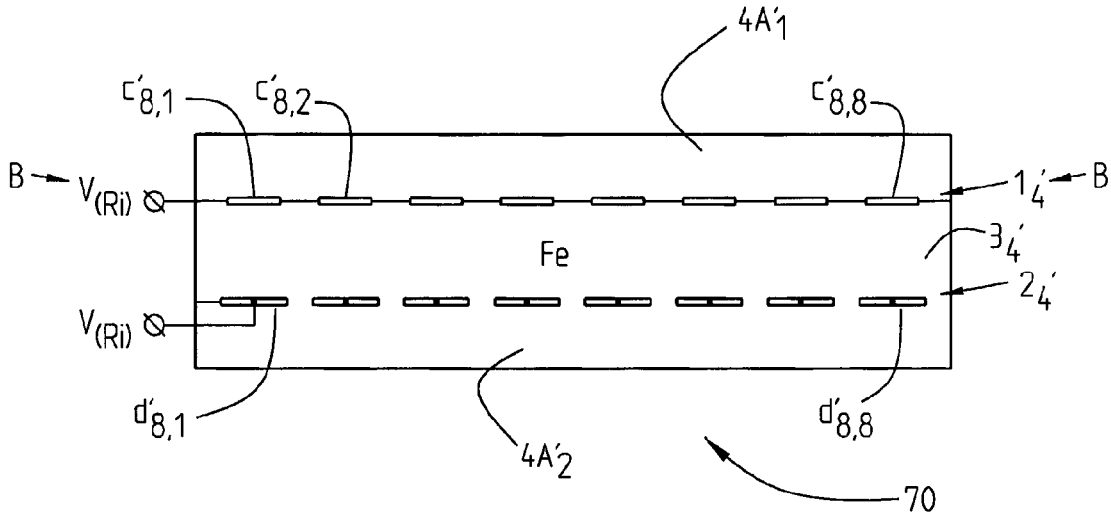
FIG. 7A is a cross-sectional view of a transmissive radiator array comprising a beam scanning antenna.
Figure 7B:
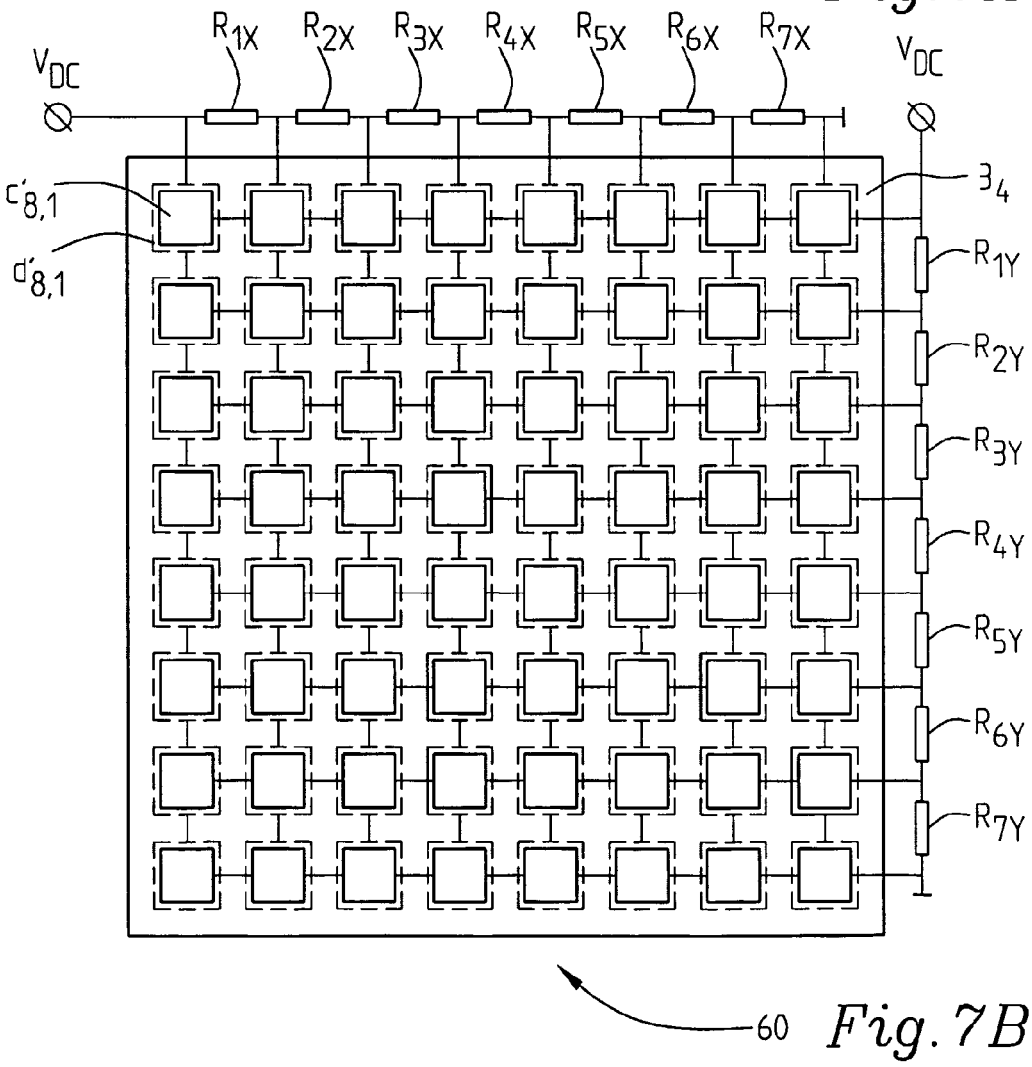
FIG. 7B is a plane view of the arrangement of FIG. 7A.

FIG. 7A is a cross-sectional view of another transmission type arrangement 70 comprising a first metal layer $\mathbf{1}_4'$ consisting of a number of radiator patches, a second metal layer $\mathbf{2}_4'$ also consisting of a number of radiator patches. In this embodiment the radiator patches of the bottom layer, i.e. of the second metal layer $\mathbf{2}_4'$, are somewhat larger than the radiator patches of the first metal layer $\mathbf{1}_4'$. Arranged between the first and second metal layers $\mathbf{1}_4'$, $\mathbf{2}_4'$ is a ferroelectric layer $\mathbf{3}_4'$ as in the preceding embodiments. Also like in the preceding embodiment the first and second metal layers respectively are surrounded by conventional dielectric layers $\mathbf{4}A'_1$, $\mathbf{4}A'_2$ on those sides thereof facing away from the ferroelectric layer $\mathbf{3}_4'$. The arrays of the first and second metal layers are DC biased illustrated in the Fig. by voltage $V(R_i)$ on, here, resistance $R_i$. In general each of the radiator in the arrays may be individually voltage biased for the purposes of tailoring the wave front. A simple biasing circuit enables scanning of the transmitted beam in X and Y directions as shown in FIG. 7B, which is a plane view of the embodiment of FIG. 7A, B indicating where the cross-section is drawn. Here two resistive DC voltage dividers are used enabling non-uniform voltage distributions in the X and Y direction respectively, and hence non-uniform changes of the dielectric permittivity and resonant frequencies of the radiators. By changing the voltages on the X and Y dividers, it gets possible to achieve a tunable, non-uniform modulation of the phase front and scanning of the transmitted beam in X and Y directions.

In this embodiment, between the connections to the external radiator patches in a row or in a column, resistors are provided, $R_{1x}, R_{2x}, \ldots, R_{7x}; R_{1y}, \ldots, R_{7y}$, indicating that the resistance may be different. The impedance means (resistors above) may alternatively comprise capacitors.

In this embodiment the first voltage divider is connected to the larger radiator patches of the second (lower) metal layer $\mathbf{2}_4'$ whereas the second voltage divider is connected to the somewhat smaller radiator patches of the first upper, metal layer $\mathbf{1}_4'$, which all are interconnected horizontally (the lower radiator patches are interconnected vertically as can be seen from the figure).

However, the radiators of the first and second metal layers $\mathbf{1}_4'$, $\mathbf{2}_4'$, i.e. on both (upper and lower) surfaces of the intermediate ferroelectric film $\mathbf{3}_4'$ may have different configurations and different coupling means.

Figure 8:
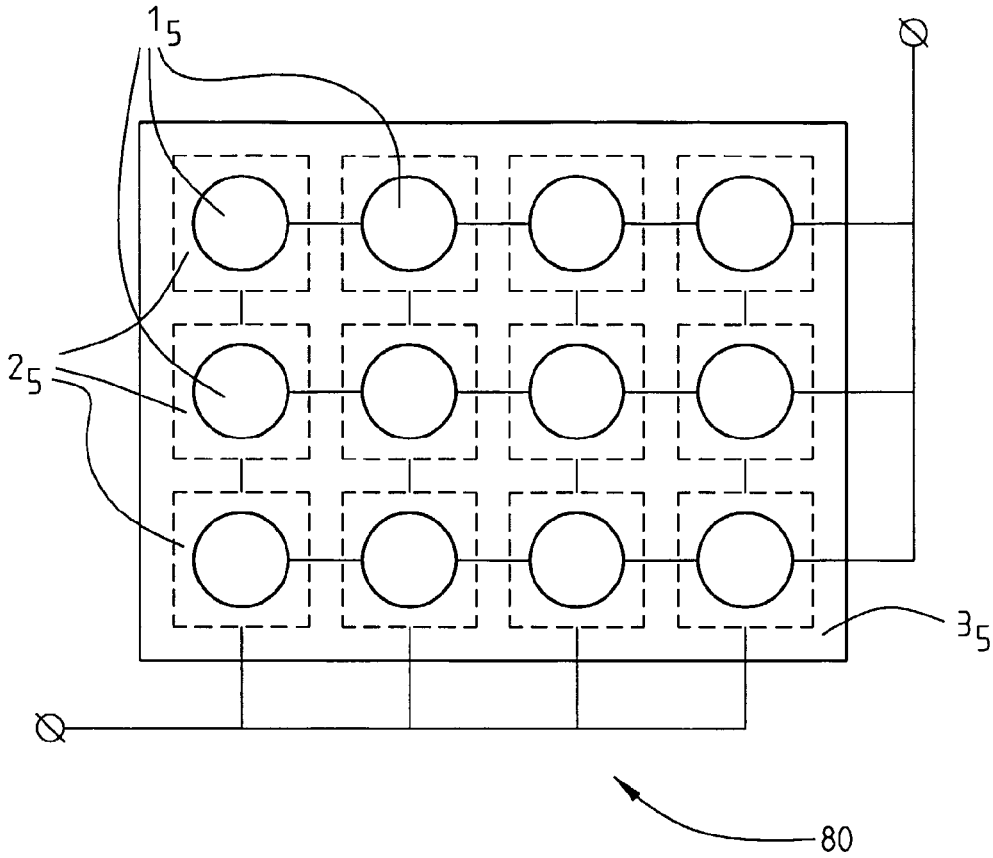
FIG. 8 shows, in a plane view, another embodiment of a transmissive radiator array comprising differently shaped radiators in the different metal layers.

An example of such an arrangement 80 is shown in FIG. 8 which shows one of many possible configurations. In this embodiment the radiator patches of the first metal layer $\mathbf{1}_5$ are circular, whereas the radiator patches of the second metal layer $\mathbf{2}_5$ are rectangular. The ferroelectric film layer indicated $\mathbf{3}_5$ is disposed between the circular and rectangular radiator arrays. In this embodiment the circular radiator patches are connected to a voltage divider (no impedance is illustrated in this figure) whereas the rectangular radiator patches are connected to another voltage divider (no impedance is illustrated). This implementation could be scanning or not, depending on whether impedances are provided (individually or groupwise to the radiator patches) or not, c.f. FIGS. 6B and 7B respectively.

Figure 9:
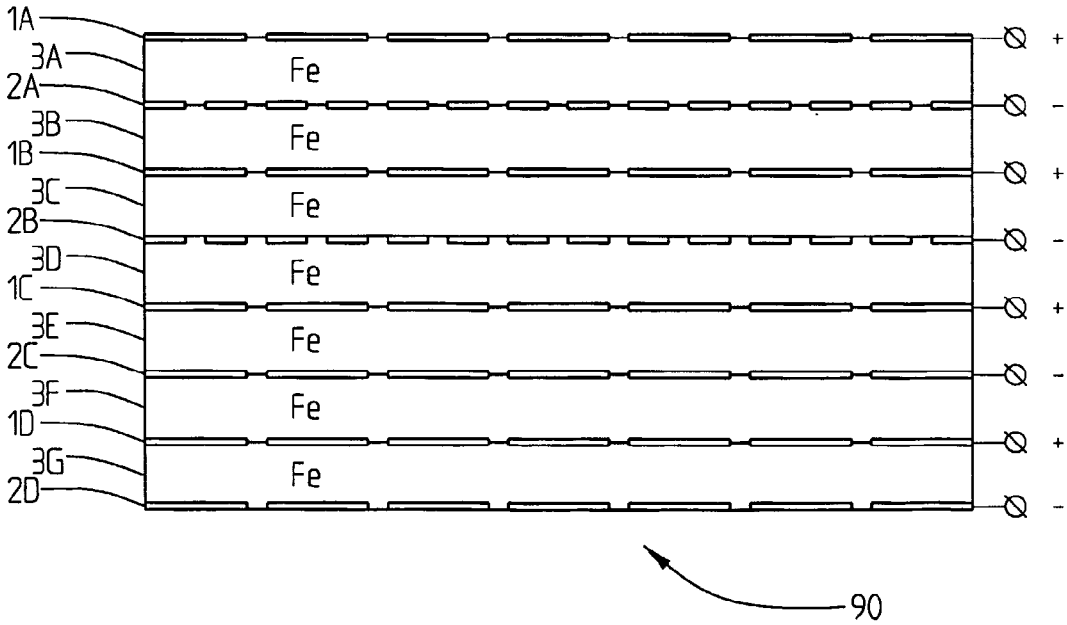
FIG. 9 is a simplified cross-sectional view of still another transmissive radiator array comprising a multilayer structure.

FIG. 9 is a very schematical cross-sectional view of a multilayer structure 90 comprising a number of ferroelectric layers 3A, . . . , 3G and a number of metal layers, 1A, 2A, 1B, 2B, 1C, 2C, 1D, 2D. A biasing DC voltage is applied to the metal layers surrounding ferroelectric layers. In other aspects the functioning is similar to that described above.

Figure 10A:
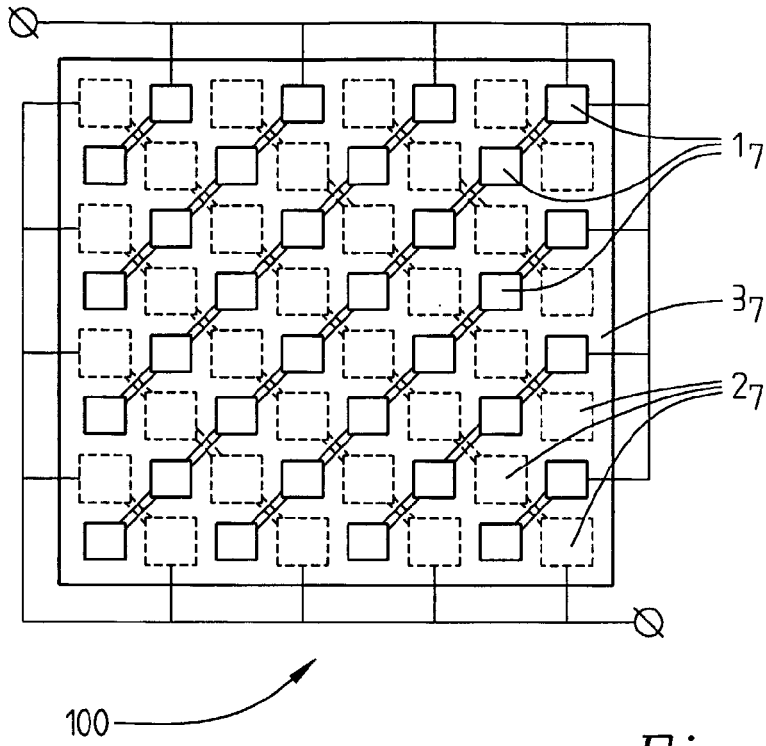
FIG. 10A shows a transmission type arrangement with differently configured radiator arrays in the first and second metal layers based on weakly (capacitively) coupled patch resonators.
Figure 10B:
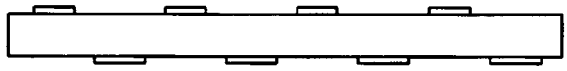
FIG. 10B is a simplified cross-sectional view of the arrangement of FIG. 10A.

FIG. 10A schematically illustrates a tunable EBG based structure 100 based on an array of weakly (capacitively) coupled patch resonators comprising a first top layer with smaller sized square shaped resonators 17, and a second metal layer 27 comprising larger sized rectangular radiator patches. A DC biasing voltage is applied, as can be seen from the figure, over one divider connected to the top layer and over another divider connected to the bottom layer. FIG. 10B is a simplified cross-sectional view of the arrangement of FIG. 10A.

Figure 11:
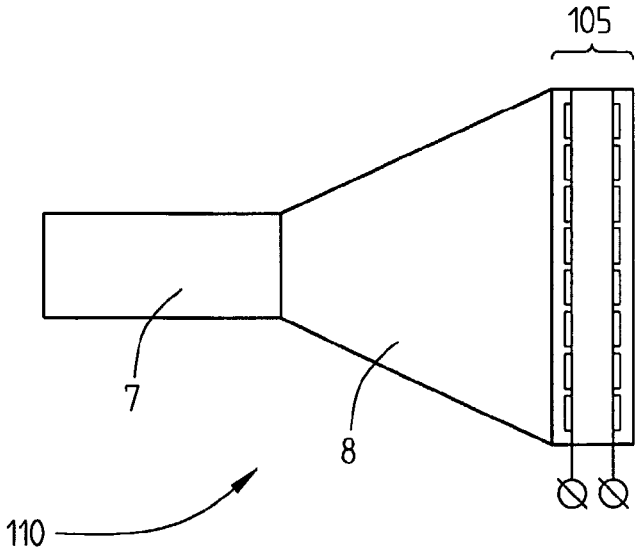
FIG. 11 shows, in a simplified manner, an arrangement in cross-section comprising a beam scanner integrating a waveguide horn and an EBG structure according to the invention.

FIG. 11 shows a tunable EBG array integrated with a waveguide 7 and a horn 8. Depending on the radiator arrangement 105, the beam radiated by the horn will be modulated or scanned in the space by changing the DC bias voltage applied to the EBG structure.

It should be clear that 3D tunable arrays in the form of electromagnetic bandgap structures, also denoted photonic bandgap structures, might be designed, using the same principles to perform complex functions such as filtering, duplexing etc. and the inventive concept can be varied in a number of ways without departing from the scope of the appended claims. It should be clear that in a number of aspects the inventive concept can be varied in a number of ways, these may e.g. be several layers of alternating ferroelectric layers/metal layers, voltage biasing can be provided for in different manners, the patch radiators can take a number of different shapes and be provided in different numbers, different materials can be used for the ferroelectric layers and metal layers (and possible surrounding dielectric layers) etc. Also in a number of other aspects the invention is not limited to the specifically illustrated embodiments.

The invention claimed is:

1. A tunable microwave/millimeter-wave arrangement comprising:

a tunable impedance surface, wherein the tunable impedance surface comprises at least one of an Electromagnetic Bandgap (EBG) structure and a Photonic Bandgap (PBG) structure, the EBG and PBG structures comprising:

at least one tunable ferroelectric layer, at least one first, top, metal layer, and at least one second metal layer, wherein the first and second metal layers are disposed on opposite sides of the at least one ferroelectric layer; at least the first metal layer is patterned; a dielectric permittivity of the at least one ferroelectric layer is dependent on a DC biasing voltage applied directly or indirectly to at least one of the first and second metal layers disposed on different sides of the at least one ferroelectric layer; at least the first metal layer is patterned such that the first metal layer comprises an array of radiators that form a two-dimensional (2D) array antenna and that are galvanically connected by via connections through the ferroelectric layer with a further second, bottom, metal layer, and a DC biasing voltage is applied to the first metal layer indirectly via the further second bottom metal layer; the 2D array antenna comprises a reflective antenna; and a radiator spacing in the first, top, metal layer is approximately $\lambda_0/30$, where $\lambda_0$ is a free-space wavelength of an incident microwave signal.

2. The arrangement of claim 1, wherein the radiators comprise resonators.

3. The arrangement of claim 2, wherein the resonators comprise patch resonators.

4. The arrangement of claim 3, wherein the patch resonators are circular, square, or rectangular.

5. The arrangement of claim 1, wherein the second metal layer is patterned, and includes openings that allow the via connections to pass to the further second metal layer, and the DC biasing voltage is applied between the two second metal layers to vary an impedance of the array of radiators.

6. The arrangement of claim 5, wherein the via connections are connected to center points of the radiators where a microwave current is substantially highest.

7. The arrangement of claim 1, wherein varying the DC biasing voltage varies an impedance of the array of radiators from inductive to capacitive.

8. The arrangement of claim 1, wherein the array of radiators comprises substantially 20×20 radiators, and a dielectric permittivity of the ferroelectric layer varies between approximately 225 and approximately 200 or is in a range between 50−n×10000, where n is an integer, the ferroelectric layer having a thickness of about 50 micrometers.

9. The arrangement of claim 1, wherein a spacing between adjacent radiators corresponds to a factor of about 0-1.5 times a wavelength of a microwave signal in the ferroelectric layer.

10. The arrangement of claim 1, wherein the arrangement comprises a three-dimensional tunable radiator array.

11. A method of controlling microwave and millimeter-wave signals, comprising the step of using an arrangement according to claim 1 for changing at least one of a phase and amplitude distribution of the signals reflected and/or transmitted through the arrangement.

12. A tunable microwave/millimeter-wave arrangement comprising:

a tunable impedance surface, wherein the tunable impedance surface comprises at least one of an Electromagnetic Bandgap (EBG) structure and a Photonic Bandgap (PBG) structure, the EBG and PBG structures comprising:

at least one tunable ferroelectric layer, at least one first, top, metal layer, and at least one second metal layer, wherein the first and second metal layers are disposed on opposite sides of the at least one ferroelectric layer; at least the first metal layer is patterned; a dielectric permittivity of the at least one ferroelectric layer is dependent on a DC biasing voltage applied directly or indirectly to at least one of the first and second metal layers disposed on different sides of the at least one ferroelectric layer; at least the first metal layer is patterned such that the first metal layer comprises an array of radiators that form a two-dimensional (2D) array antenna and that are galvanically connected by via connections through the ferroelectric layer with a further second, bottom, metal layer, and a DC biasing voltage is applied to the first metal layer indirectly via the further second bottom metal layer; radiators are arranged in at least two 2D arrays, comprising the first and second metal layers between which the ferroelectric layer is disposed; the arrays comprise a transmission antenna; the DC biasing voltage applied to each radiator is controllable via an impedance device; and the arrangement comprises a beam scanning antenna.

13. The arrangement of claim 12, wherein dielectric or ferroelectric layers are provided on sides of the first and second metal layers and are not in contact with the ferroelectric layer.

14. The arrangement of claim 12, wherein a DC voltage is applied to the metal layers and is provided to each individual radiator for changing a dielectric permittivity of the ferroelectric layer.

15. The arrangement of claim 14, wherein the arrangement comprises a wavefront phase modulator for changing a phase of a transmitted microwave signal.

16. The arrangement of claim 14, wherein the radiator arrays are integrated with a waveguide horn such that by changing the DC biasing voltage the horn varies a microwave signal.

17. The arrangement of claim 12, wherein separate DC voltage dividers are connected to the radiators, one in an x-direction for radiators of one metal plane and one in a y-direction for radiators of another metal plane, thereby enabling non-uniform voltage distribution in the x- and y-directions and tunable, non-uniform modulation of a microwave signal phase front.

18. The arrangement of claim 17, wherein the impedance devices comprise resistors.

19. The arrangement of claim 18, wherein each radiator is individually connected to the DC biasing voltage over a separate resistor.

20. The arrangement of claim 17, wherein the impedance devices comprise capacitors.

21. The arrangement of claim 12, wherein a thickness of the ferroelectric layer is between about 1 micrometer and several millimeters, and the DC biasing voltage ranges from 0 volts to several thousand volts.

22. The arrangement of claim 12, wherein the radiators comprise resonators.

23. The arrangement of claim 22, wherein the resonators comprise patch resonators.

24. The arrangement of claim 23, wherein the patch resonators are circular, square, or rectangular.

25. The arrangement of claim 12, wherein the second metal layer is patterned, and includes openings that allow the via connections to pass to the further second metal layer, and the DC biasing voltage is applied between the two second metal layers to vary an impedance of the array of radiators.

26. The arrangement of claim 25, wherein the via connections are connected to center points of the radiators where a microwave current is substantially highest.

27. The arrangement of claim 12, wherein varying the DC biasing voltage varies an impedance of the array of radiators from inductive to capacitive.

28. The arrangement of claim 12, wherein the array of radiators comprises substantially 20×20 radiators, and a dielectric permittivity of the ferroelectric layer varies between approximately 225 and approximately 200 or is in a range between 50−n×10000, where n is an integer, the ferroelectric layer having a thickness of about 50 micrometers.

* * * * *

UNITED STATES PATENT AND TRADEMARK OFFICE

CERTIFICATE OF CORRECTION

PATENT NO. : 7,903,040 B2
APPLICATION NO. : 10/597811
DATED : March 8, 2011
INVENTOR(S) : Gevorgian et al.

It is certified that error appears in the above-identified patent and that said Letters Patent is hereby corrected as shown below:

In Column 7, Line 40, delete "13." and insert -- $1_3$. --, therefor.

In Column 7, Line 41, delete "23." and insert -- $2_3$. --, therefor.

Signed and Sealed this
Thirtieth Day of August, 2011

David J. Kappos

David J. Kappos
*Director of the United States Patent and Trademark Office*